US005509778A

United States Patent [19]

Hantle et al.

[11] Patent Number: 5,509,778

[45] Date of Patent: Apr. 23, 1996

[54] FUEL PUMP FOR MOTOR VEHICLE

[75] Inventors: Edward A. Hantle, deceased, late of Caro, by Kathleen A. Hantle, personal representative; Orrin A. Woodward, Davison; David E. Harris, Frankenmuth; John G. Fischer, Goodrich, all of Mich.

[73] Assignee: General Motors Corporation, Detroit, Mich.

[21] Appl. No.: 391,856

[22] Filed: Feb. 22, 1995

[51] Int. Cl.[6] ..... F04D 5/00

[52] U.S. Cl. ..... 415/55.1; 415/55.2; 415/169.1

[58] Field of Search ..... 415/55.1, 55.2, 415/55.3, 55.4, 55.6, 169.1; 417/203, 205

[56] References Cited

U.S. PATENT DOCUMENTS

| | | | |
|---|---|---|---|
| 3,418,991 | 12/1968 | Schultz et al. . | |
| 3,881,839 | 5/1975 | MacManus . | |
| 4,591,311 | 5/1986 | Matsuda et al. . | |
| 4,653,979 | 3/1987 | Schillinger . | |
| 4,793,766 | 12/1988 | Kumata . | |
| 5,149,252 | 9/1992 | Tuckey et al. . | |
| 5,160,249 | 11/1992 | Iwai et al. | 415/55.2 |
| 5,284,417 | 2/1994 | Yu | 415/55.1 |
| 5,336,045 | 8/1994 | Koyama et al. | 415/55.1 |
| 5,348,442 | 9/1994 | Harris et al. . | |

*Primary Examiner*—Edward K. Look
*Assistant Examiner*—James A. Larson
*Attorney, Agent, or Firm*—Saul Schwartz

[57] ABSTRACT

An open-vane regenerative turbine pump in an electric fuel pump operating submerged in fuel in a fuel tank of a motor vehicle. The regenerative turbine pump includes an open-vane impeller having paddle-like vanes extending radially out from a ring-shaped body of the impeller, an annular groove in a housing of the pump defining a pump channel around the periphery of the impeller and the vanes, a stripper on the pump housing fitting close around the impeller between an inlet port of the pump channel and a discharge port of the pump channel, a pair of radial vapor ports on opposite sides of the impeller at an inside diameter of the annular pump channel, and a pair of steps on opposite sidewalls of the pump channel sweeping downstream from an outside diameter of the pump channel to the inside diameter thereof at downstream sides of corresponding ones of the radial vapor ports. The swept-back steps on the sidewalls of the pump channel gradually reduce the cross sectional area of the pump channel to increase flow velocity in the pump channel ahead of the vapor ports for more thorough scavenging of vapor.

1 Claim, 2 Drawing Sheets

FUEL PUMP FOR MOTOR VEHICLE

FIELD OF THE INVENTION

This invention relates to a motor vehicle fuel pump having an open-vane regenerative turbine pump therein.

BACKGROUND OF THE INVENTION

U.S. Pat. No. 3,881,839, issued 6 May 1975 and assigned to the assignee of this invention, describes an electric fuel pump which operates submerged in fuel in a fuel tank of a motor vehicle and which includes an open-vane regenerative turbine pump. A plurality of paddle-like radial vanes on a rotating impeller of the turbine pump induce fluid flow in an annular pump channel around the periphery of the impeller. Vapor which is separated from liquid fuel in the pump channel is expelled therefrom through vapor discharge ports near the inside diameter of the pump channel. In an open-vane regenerative turbine pump in an electric fuel pump described in U.S. Pat. No. 3,418,991, issued 31 Dec. 1968 and assigned to the assignee of this invention, vapor discharges from the annular pump channel through predetermined lateral clearance between the pump housing and the sides of the impeller at the inside diameter of the pump channel. A closed-vane regenerative turbine pump described in U.S. Pat. No. 4,591,311 includes an impeller, an annular pump channel around the periphery of the impeller, a pair of abrupt steps in the pump channel on opposite sides of the impeller, and a lateral vapor port in a stagnation zone upstream of one of the abrupt steps.

SUMMARY OF THE INVENTION

This invention is a new and improved open-vane regenerative turbine pump in an electric fuel pump operating submerged in fuel in a fuel tank of a motor vehicle. The regenerative turbine pump according to this invention includes an open-vane impeller having paddle-like vanes extending radially out from a ring-shaped body of the impeller, an annular groove in a housing of the pump defining a pump channel around the periphery of the impeller and the vanes, a stripper on the pump housing fitting close around the impeller between an inlet port of the pump channel and a discharge port of the pump channel, a pair of radial vapor ports on opposite sides of the impeller at an inside diameter of the annular pump channel, and a pair of steps on opposite sidewalls of the pump channel sweeping downstream from an outside diameter of the pump channel to the inside diameter thereof at downstream sides of corresponding ones of the radial vapor ports. The swept-back steps on the sidewalls of the pump channel gradually reduce the cross sectional area of the pump channel upstream of the radial ports to increase flow velocity in the pump channel ahead of the vapor ports for more thorough scavenging of vapor which clings to the stationary surfaces defining the inside diameter of the pump channel.

DESCRIPTION OF A PREFERRED EMBODIMENT

Figure 1:
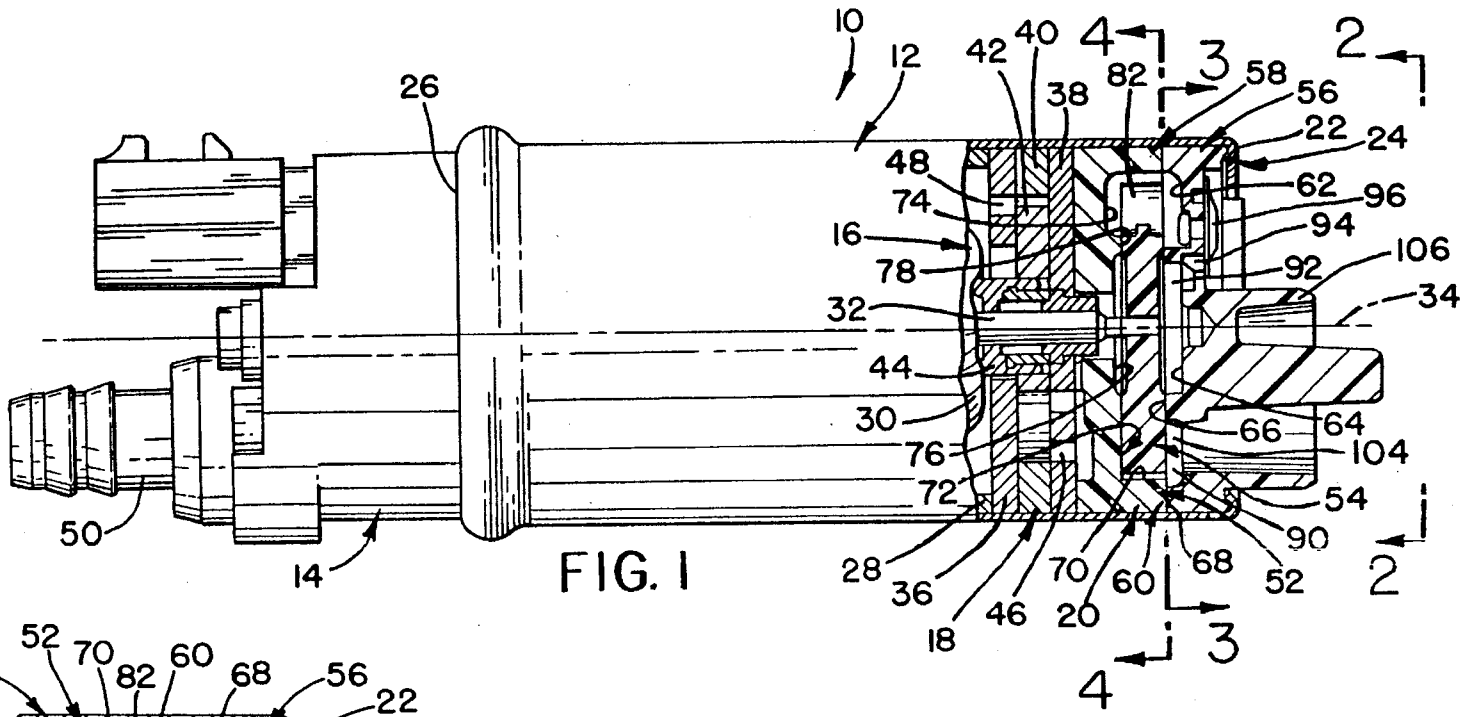
FIG. 1 is a fragmentary, partially broken-away view of an electric fuel pump including an open-vane regenerative turbine pump according to this invention.

Referring to FIG. 1, an electric fuel pump 10 adapted to operate submerged in fuel in a motor vehicle fuel tank, not shown, has a thin-walled tubular shell 12 enclosing an end housing 14, an electric motor 16, a roller vane pump 18, and an open-vane regenerative turbine pump 20 according to this invention. An annular lip 22 at an open first end 24 of the shell prevents dislodgement of the motor 16 and the pumps 18,20 through the first end. The shell is magnaformed around a shoulder on the end housing 14 whereby a second end 26 of the shell is sealed closed and dislodgement of the end housing, the motor, and the pumps through the second end is prevented.

The electric motor 16 includes a cylindrical flux carrier 28, field magnets, not shown, mounted on the flux carrier, and an armature 30 having a shaft 32 supported on the shell 12 by the end housing 14 and by the roller vane pump 18 for rotation about a longitudinal centerline 34 of the shell. The roller vane pump 18 includes a first disc-shaped side plate 36, a second disc-shaped side plate 38, a cam ring 40 between the side plates, and a rotor 42 between the side plates 36,38 inside the ring 40. The rotor has a plurality of outwardly opening roller pockets, not shown, with rollers therein bearing against the cam ring and cooperating therewith in well known fashion in defining variable volume pumping chambers.

The rotor 42 is rotated by the armature 30 through a driver 44 integral with the armature. When the electric motor is on, the pumping chambers between the rollers on the rotor pump fuel from an inlet port 46 of the roller vane pump in the side plate 38 to a discharge port 48 of the roller vane pump in the side plate 36. Fuel discharged from the discharge port 48 of the roller vane pump flows around the armature 30 and discharges from the fuel pump through a tubular connector 50 on the end housing 14, FIG. 1.

The open-vane regenerative turbine pump 20 according to this invention includes a two-piece housing 52 and an open-vane impeller 54. The housing 52 is captured between the lip 22 on the shell 12 and the side plate 38 of the roller vane pump 18 and includes an outer disc 56 exposed to the fuel tank through the open first end 24 of the shell 12 and an inner disc 58 between the side plate 38 and the outer disc.

Figure 5:
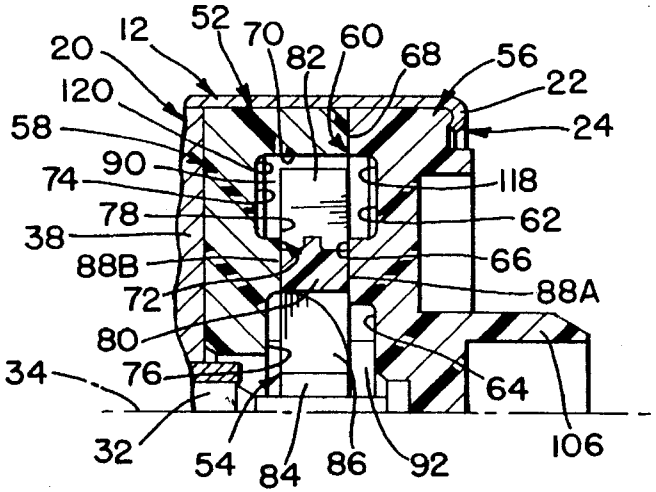
FIG. 5 is a sectional view taken generally in the direction indicated by lines 5—5 in FIGS. 3 and 4.
Figure 3:
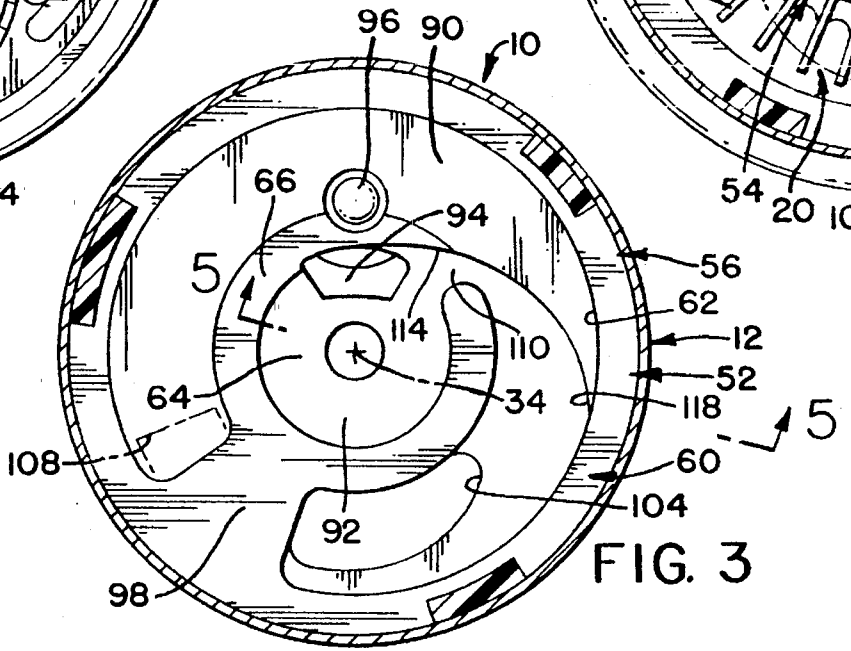
FIG. 3 is a sectional view taken generally along the plane indicated by lines 3—3 in FIG. 1.

As best seen in FIGS. 1, 3 and 5, a flat side 60 of the outer disc 56, perpendicular to the centerline 34 and facing the inner disc 58, has a shallow, substantially annular groove 62 therein around a shallow circular spotface 64 in the flat side 60. The portion of the outer disc 56 between the groove 62 and the spotface 64 defines an annular boss 66 which terminates in the plane of the flat side 60.

A flat side 68 of the inner disc 58, perpendicular to the centerline 34 and facing the flat side 60 on the outer disc, has a cylindrical cavity therein including a side wall 70 symmetric about the centerline 34 and a flat bottom wall 72 in a plane perpendicular to the centerline 34. The bottom wall 72 has a shallow, substantially annular groove 74 therein around a similarly shallow circular spotface 76 in the bottom wall, FIGS. 1, 4 and 5. The groove 74 and spotface 76 are opposite the groove 62 and spotface 64 in the outer disc 56.

The portion of the inner disc 58 between the groove 74 and the spotface 76 defines an annular boss 78 which terminates in the plane of the bottom wall 72 opposite the annular boss 66 on the outer disc.

Figure 4:
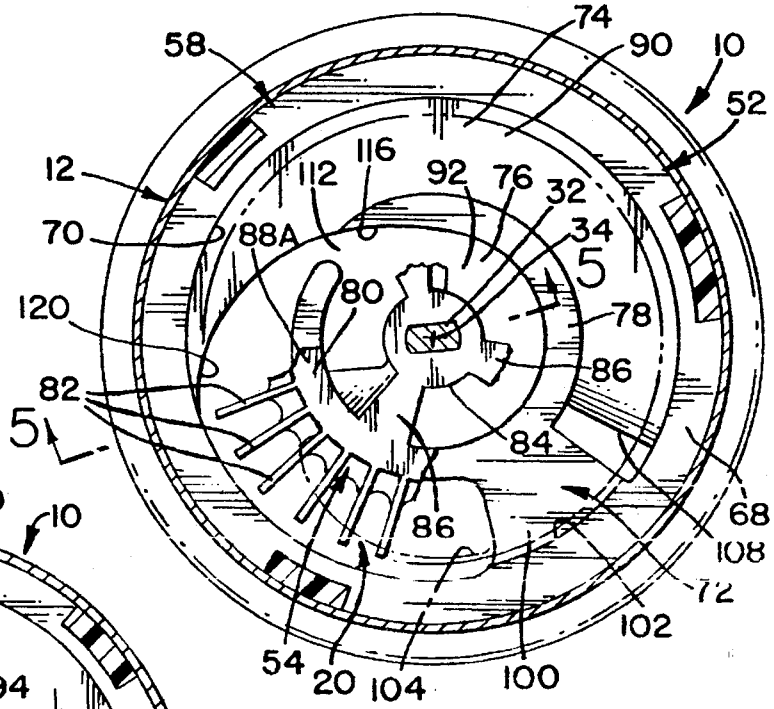
FIG. 4 is a partially broken-away sectional view taken generally along the plane indicated by lines 4—4 in FIG. 1.

As seen best in FIGS. 4 and 5, the open-vane impeller 54 is preferably made of molded plastic and includes a ring-shaped body 80, a plurality of paddle-like vanes 82 projecting radially out from the body 80, a hub 84, and a plurality of radial spokes 86 between the body 80 and the hub 84. The spokes 86 define a plurality of fan blades as described more fully in U.S. Pat. No. 4,734,008, issued 29 Mar. 1988 and assigned to the assignee of this invention. The ring-shaped body 80 has a pair of annular sides 88A–B in parallel planes. The "open-vane" designation for impeller 54 derives from the absence of webs between the vanes 82 reaching or extending to the tips of the vanes.

The impeller 54 is captured between the inner and outer discs 58,56 in the aforesaid cylindrical cavity and connected to the armature shaft 32 at the hub 84 whereby the impeller 54 is rotated by the electric motor 16 concurrently with the rotor 42 in the roller vane pump 18. The annular sides 88A–B of the body of the impeller 54 are closely adjacent the annular bosses 66,78 on the outer and inner discs 56,58, respectively, so that the annular grooves 62,74 and the side wall 70 of the cavity cooperate in defining an annular pump channel 90, FIG. 5, around the periphery of the impeller 54 and the vanes 82. An outside diameter of the annular pump channel 90 is defined by the wall 70. Sidewalls of the annular pump channel 90 in planes perpendicular to the centerline 34 are defined by the bottoms of the annular grooves 62,74. A pair of inside diameters of the annular pump channel 90 on opposite sides of the impeller 54 are defined by the annular bosses 66, 78.

The spotfaces 64,76 cooperate with the interstices between the spokes 86 of the impeller in defining a vapor collection chamber 92 of the pump 20 radially inboard of the annular pump channel 90. The vapor collection chamber is in flow communication with the fuel tank through a vapor discharge port 94 in the outer disc. A flexible umbrella valve 96 on the outer disc covers the vapor discharge port and prevents backflow from the fuel tank into the vapor collection chamber.

As seen best in FIGS. 1, 3 and 4, the annular groove 62 in the outer disc 56 is interrupted by a stripper 98 in the plane of the flat side 60. Likewise, the annular groove 74 in the bottom wall 72 of the cavity in the inner disc is interrupted by a stripper 100 opposite the stripper 98 in the plane of the bottom wall 72. The side wall 70 of the cavity in the inner disc has a reduced radius portion 102, FIG. 4, aligned with the strippers 98,100 and defining a circumferential stripper closely adjacent the tips of the vanes 82.

Figure 2:
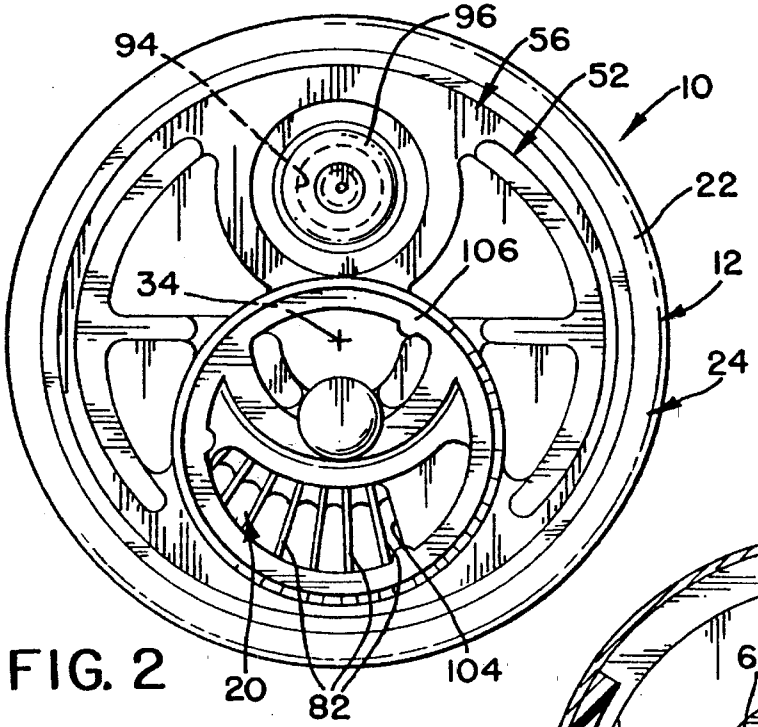
FIG. 2 is a view taken generally along the plane indicated by lines 2—2 in FIG. 1.

The pump channel 90 communicates with the fuel tank through an inlet port 104 in the outer disc 56 adjacent one side of the stripper 98. On the side of the outer disc 56 facing the fuel tank, the inlet port 104 is surrounded by a boss 106, FIGS. 1–2, where a screen may conveniently be attached. The pump channel 90 is in flow communication with the inlet port 46 of the roller vane pump 18 through a discharge port 108 in the inner disc 58 on the opposite side of the stripper 100 from the inlet port 104.

As seen best in FIGS. 3–5, the annular boss 66 is interrupted by a first radial vapor port 110 providing flow communication between the pump channel 90 at the inside diameter thereof and the vapor collection chamber 92. The annular boss 78 is interrupted by a second radial vapor port 112 opposite the first vapor port 110 providing flow communication between the pump channel 90 at the inside diameter thereof and the vapor collection chamber 92 on the opposite side of the impeller 54 from the first vapor port. The first vapor port 110 has a downstream side 114 facing toward the inlet port 104 and swept back in the downstream direction. The second vapor port 112 has a downstream side 116 facing toward the inlet port 104 and swept back in the downstream direction.

A first step 118 in the sidewall of the pump channel 90 defined by the bottom of the annular groove 62 sweeps smoothly downstream from a point on the outside diameter of the pump channel upstream of the first vapor port 110 to the inside diameter of the pump channel 90 at the intersection thereof with the downstream side 114 of the first vapor port. The downstream side 114 of the first vapor port is a smooth continuation of the first step. A second step 120 in the sidewall of the pump channel 90 defined by the bottom of the annular groove 74 sweeps smoothly downstream opposite the first step from the outside diameter of the pump channel upstream of the second vapor port 112 to the inside diameter of the pump channel at the intersection thereof with the downstream side 116 of the second vapor port. The downstream side 116 of the second vapor port is a smooth continuation of the second step. The first and second steps 118,120 gradually reduce the cross sectional area of the pump channel 90 from a maximum upstream of the steps to a minimum where the steps merge with the downstream sides 114,116 of the first and second vapor ports.

The turbine pump 20 operates as follows. When the electric motor is on, the armature shaft 32 rotates the rotor 42 and the impeller 54 at about 5500 rpm. Fuel enters the pump channel 90 through the inlet port 104 and is pumped in well known regenerative turbine fashion by the impeller vanes 82 in the arc of the pump channel toward the discharge port 108. Vapor entering the pump channel with the liquid fuel, being less dense than the liquid fuel, is forced radially inward in the pump channel and is transported downstream as a vapor/liquid mixture near the inside diameter of the pump channel 90. When the vapor/liquid mixture reaches the radial vapor ports 110,112, it is expelled from the pump channel through the vapor ports into the vapor collection chamber 92 by reason of a pressure gradient therebetween. The fan blades defined by the spokes 86 on the impeller 54 contribute to expulsion of the vapor/liquid mixture from the chamber 92 through the vapor discharge port 94.

The swept-back steps 118,120 on the sidewalls of the pump channel 90 perpendicular to the centerline 34 and the smooth transitions thereof to the downstream sides 114,116 of the radial vapor ports are important features of this invention and contribute to improved vapor scavenging performance of the open-vane regenerative turbine pump 20 in comparison to similar turbine pumps having only straight or uninterrupted sidewalls and to similar turbine pumps having lateral vapor ports. Such improved performance is believed to be attributable, first, to the gradual reduction in cross sectional area of the pump channel and the corresponding gradual increase in flow velocity, and, second, to the smooth transition between the steps and the downstream sides of the radial vapor ports. The gradually increasing flow velocity more fully removes or scavenges vapor from the inside diameter of pump channel which vapor otherwise clings to the stationary surfaces defining the pump channel. The smooth transition between the steps and the downstream sides of the radial vapor ports minimizes obstruction to outflow of the vapor/liquid mixture from the pump channel.

The embodiments of the invention in which an exclusive property or privilege is claimed are defined as follows:

1. An open-vane regenerative turbine pump comprising:

a housing, an impeller mounted on the housing for rotation about a centerline thereof having a body and a plurality of paddle-like open-vane type vanes extending radially out from said body, an annular pump channel in said housing around the periphery of said impeller and around said vanes having a pair of sidewalls each in a plane perpendicular to said centerline, a stripper on said housing in said pump channel closely adjacent said impeller, an inlet port in said housing connected to said pump channel closely adjacent a first side of said stripper, a discharge port in said housing connected to said pump channel closely adjacent a second side of said stripper, a vapor collection chamber in said housing radially inboard of said pump channel and separated therefrom by a pair of annular bosses on said housing closely adjacent respective ones of a pair of opposite sides of said impeller, a pair of radial vapor ports in respective ones of said pair of annular bosses between said inlet port and said discharge port each providing flow communication between said pump channel and said vapor collection chamber and each having a downstream side facing in the direction of said inlet port swept-back in a downstream direction, and a pair of steps on respective ones of said sidewalls of said pump channel each sweeping in a downstream direction for smooth transition with a corresponding one of said radial vapor ports from a point on an outside diameter of said annular pump channel upstream of said corresponding one of said pair of radial vapor ports to an inside diameter of said pump channel at said downstream side of said corresponding one of said radial vapor ports to gradually reduce the cross sectional area of said pump channel from a maximum upstream of said swept-back steps to a minimum at said downstream sides of said radial vapor ports.

* * * * *